US009166309B1

(12) United States Patent
Costello et al.

(10) Patent No.: US 9,166,309 B1
(45) Date of Patent: Oct. 20, 2015

(54) BUS BAR WITH CONNECTOR SHROUD

(71) Applicant: Tyco Electronics Corporation, Berwyn, PA (US)

(72) Inventors: Brian Patrick Costello, Scotts Valley, CA (US); Joshua Tyler Sechrist, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/317,867

(22) Filed: Jun. 27, 2014

(51) Int. Cl.

| | |
|---|---|
| ***H01R 12/00*** | (2006.01) |
| ***H01R 9/26*** | (2006.01) |
| ***H01R 25/16*** | (2006.01) |
| ***H01R 13/46*** | (2006.01) |
| ***H01R 9/24*** | (2006.01) |

(52) U.S. Cl.
CPC ..... *H01R 9/2675* (2013.01); *H01R 9/2466* (2013.01); *H01R 13/46* (2013.01); *H01R 25/161* (2013.01); *Y10S 439/949* (2013.01)

(58) Field of Classification Search
CPC ..... H01R 9/2675; Y10S 439/949
See application file for complete search history.

(56) References Cited

U.S. PATENT DOCUMENTS

| | | | | |
|---|---|---|---|---|
| 3,941,443 | A * | 3/1976 | Reimer | 439/510 |
| 4,840,568 | A * | 6/1989 | Burroughs et al. | 439/49 |
| 5,013,247 | A * | 5/1991 | Watson | 439/55 |
| 5,173,061 | A * | 12/1992 | Comerci et al. | 439/536 |
| 5,626,492 | A * | 5/1997 | Onizuka et al. | 439/512 |
| 5,703,757 | A * | 12/1997 | Hayes et al. | 361/752 |
| 6,361,375 | B1 * | 3/2002 | Sinclair | 439/723 |
| 6,402,569 | B1 * | 6/2002 | Spadoni et al. | 439/723 |
| 6,468,102 | B1 * | 10/2002 | Murakami et al. | 439/404 |
| 6,722,926 | B2 * | 4/2004 | Chevassus-More | 439/721 |
| 8,313,354 | B2 * | 11/2012 | McAlonis et al. | 439/884 |
| 8,388,389 | B2 | 3/2013 | Costello et al. | |
| 8,986,030 | B2 * | 3/2015 | Billman et al. | 439/249 |
| 2001/0000762 | A1 * | 5/2001 | Shepherd | 439/55 |
| 2001/0036766 | A1 * | 11/2001 | Katoh et al. | 439/395 |
| 2001/0049211 | A1 * | 12/2001 | Sumida et al. | 439/76.2 |
| 2002/0009907 | A1 * | 1/2002 | Kasai et al. | 439/76.2 |
| 2004/0058570 | A1 * | 3/2004 | Oda et al. | 439/76.2 |
| 2004/0185698 | A1 * | 9/2004 | Hara | 439/212 |
| 2007/0165376 | A1 * | 7/2007 | Bones et al. | 361/688 |
| 2011/0254649 | A1 * | 10/2011 | Hollevoet et al. | 336/200 |
| 2012/0122335 | A1 * | 5/2012 | Costello | 439/502 |
| 2012/0202383 | A1 * | 8/2012 | Harao et al. | 439/620.29 |
| 2012/0217032 | A1 * | 8/2012 | Beaupre et al. | 174/32 |
| 2014/0111959 | A1 * | 4/2014 | Li et al. | 361/809 |

* cited by examiner

*Primary Examiner* — James Harvey

(57) ABSTRACT

An electrical system includes a bus bar having a plurality of layers including a conductive power layer and a conductive ground layer. The bus bar has a front edge with a plurality of tabs extending therefrom at spaced-apart locations. Each tab includes a power finger extending from the power layer and a ground finger extending from the ground layer. The bus bar also includes a connector shroud coupled to the front edge of the bus bar. The connector shroud has a base, a mating end, and a cavity defined therebetween. The cavity receives one of the tabs through the base. The mating end is configured to mate with an electrical connector. The cavity is configured to receive power and ground contacts of the electrical connector therein for electrical connection to the respective power and ground fingers of the tab.

20 Claims, 5 Drawing Sheets

BUS BAR WITH CONNECTOR SHROUD

BACKGROUND OF THE INVENTION

The subject matter herein relates generally to electrical bus bars having connector shrouds for connecting to mating connectors.

In some electrical systems, power is delivered to a circuit board, an electrical device, and/or other electrical components through a bus bar. A bus bar typically includes one or more planar strips of conductive material, such as copper. One strip or layer may be used to convey electrical power, and another strip or layer may be used as a ground. Bus bars may be preferable for carrying power to electrical components over other components, such as circuit boards or cables, due to a generally higher current carrying capacity and better inductance with bus bars.

The power on the bus bar is distributed to electrical components using connectors. One known type of connector for use with bus bars is a two-piece design in which a first connector is mounted to the bus bar, and a second, mating connector removably mates to the mounted first connector. In two-piece designs, it is often difficult and expensive to mount the first connector to the bus bar. For example, some typical methods of mounting connectors to circuit boards, such as soldering, are not feasible for mounting connectors to bus bars. In addition, the bus bar is typically formed of multiple layers of thin conductive sheets, and the first connector may include contacts that require electrical connection to different layers of the thin conductive sheets.

Another known type of connector involves a single-piece design in which a mating connector mates directly to the bus bar, typically at an edge, such that the edge of the bus bar is received in a space between two sets of contacts. Because the bus bar may be relatively thin and infirm, the forces imparted on the bus bar during mating and un-mating of the connector may damage the bus bar. In addition, often the space between contacts of the connector is not adjustable, so the connector may only accommodate bus bars within a narrow range of thicknesses. As a result, the type and/or size of the connectors configured to mate with the bus bar may need to be specifically selected based on the thickness of the bus bar used in a given application. Furthermore, the contacts of the single-piece connector mate directly to the electrified layers of the bus bar, so when the connector is removed from the bus bar, the exposed area of the bus bar may be hazardous to the touch.

A need remains for an electrical system that allows a mating connector to electrically couple to a bus bar without the problems identified above that are associated with known electrical systems.

BRIEF DESCRIPTION OF THE INVENTION

In one embodiment, an electrical system is provided that includes a bus bar and a connector shroud. The bus bar has a first side and a second side. The bus bar includes a plurality of layers between the first and second sides. The layers include a conductive power layer and a conductive ground layer. The bus bar has a front edge that defines a plurality of tabs extending therefrom at spaced-apart locations along the front edge. Each tab includes a power finger extending from the power layer and a ground finger extending from the ground layer. The connector shroud is coupled to the front edge of the bus bar. The connector shroud has a base and a mating end and defines a cavity therebetween. The cavity receives one of the tabs through an opening at the base. The mating end defines a mating interface configured to mate with an electrical connector. The cavity is configured to receive power and ground contacts of the electrical connector therein for electrical connection to the respective power and ground fingers of the tab.

In another embodiment, an electrical system is provided that includes a bus bar assembly and a connector shroud. The bus bar assembly includes first and second bus bars. Each bus bar includes a conductive power layer and a conductive ground layer. Each bus bar has a front edge defining a plurality of tabs extending therefrom. Each tab includes a power finger extending from the power layer and a ground finger extending from the ground layer. The bus bar assembly has a first side and a second side. The conductive power layer of the first bus bar defines the first side and the conductive power layer of the second bus bar defines the second side such that the conductive ground layers of the first and second bus bars are disposed between the conductive power layers. The connector shroud is coupled to a front edge of the bus bar assembly defined by the front edges of the first and second bus bars. The connector shroud has a base and a mating end and defines a cavity therebetween. The cavity receives at least one of the tabs of the bus bar assembly through an opening at the base. The mating end defines a mating interface configured to mate with an electrical connector. The cavity is configured to receive power and ground contacts of the electrical connector therein for electrical connection to the respective power and ground fingers of the at least one tab within the cavity.

DETAILED DESCRIPTION OF THE INVENTION

Figure 1:
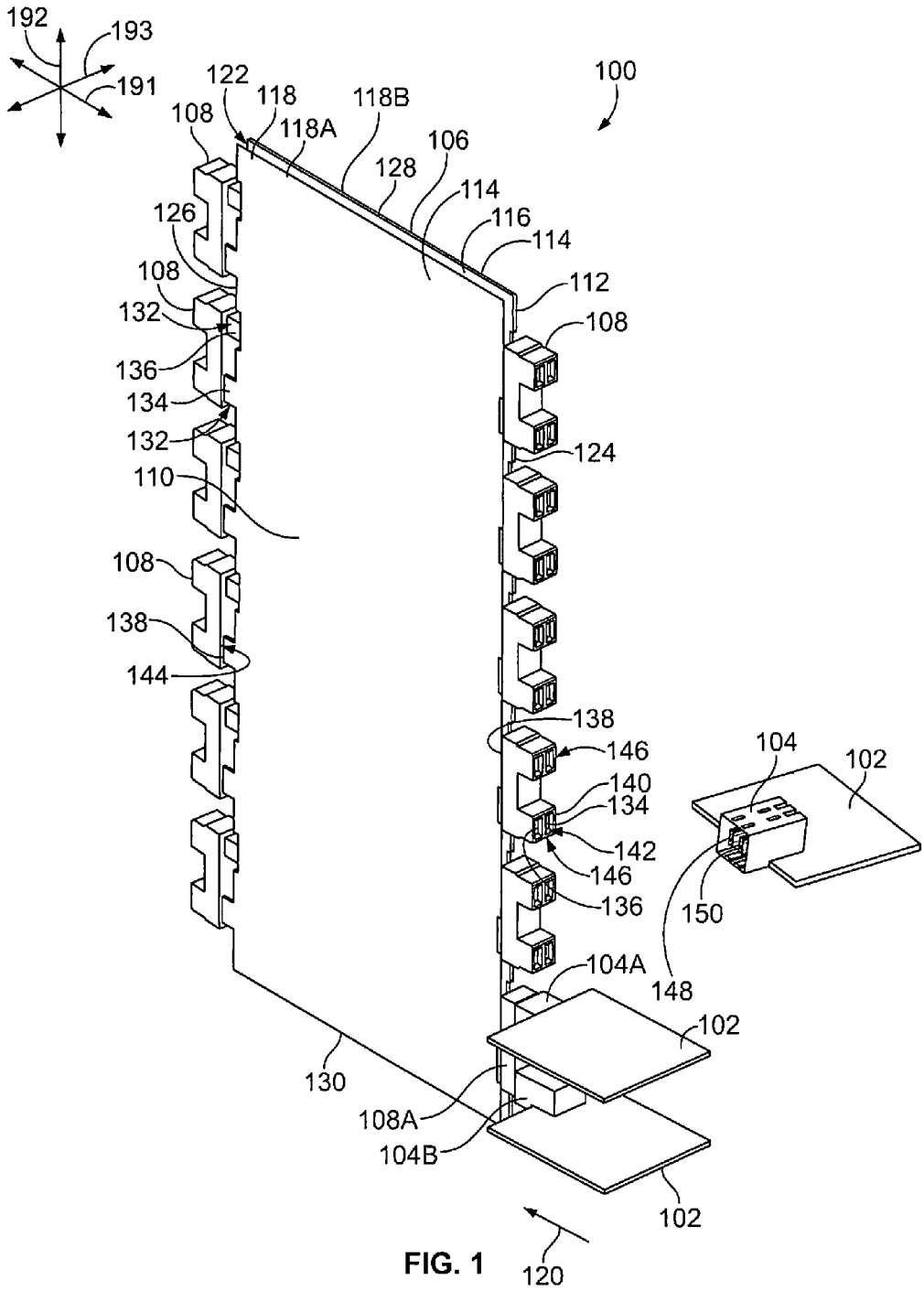
FIG. 1 is a perspective view of an electrical system formed in accordance with an exemplary embodiment.

FIG. 1 is a perspective view of an electrical system 100 formed in accordance with an exemplary embodiment. The electrical system 100 includes an electrical element 102 (for example, a circuit board), an electrical connector 104 that is mounted to the electrical element 102, and a bus bar assembly 106 that is configured to electrically engage the electrical connector 104. The bus bar assembly 106 is a conductive component that is designed to conduct electrical current to one or more receiving electrical elements 102 in order to power the electrical element(s) 102 to perform designated functions. The electrical system 100 further includes a connector shroud 108. The connector shroud 108 is coupled to the bus bar assembly 106. The connector shroud 108 guides the electrical connector 104 into electrical and mechanical engagement with the bus bar assembly 106. As shown in FIG.

1, the electrical system 100 is oriented with respect to mutually perpendicular axes 191-193 that include a longitudinal axis 191, an elevation or vertical axis 192, and a lateral (or horizontal) axis 193. Although the elevation axis 192 appears to extend in a vertical direction parallel to gravity in FIG. 1, it is understood that the axes 191-193 are not required to have any particular orientation with respect to gravity.

In the illustrated embodiment, the electrical element 102 is a printed circuit board. The electrical connector 104 is a right angle connector that mounts to one side of the printed circuit board 102. For example, the electrical connector 104 is mated to the bus bar assembly 106 in a mating direction 120 that is parallel to the plane of the printed circuit board 102. The mating direction 120 may be along or parallel to the longitudinal axis 191. While the electrical connector 104 is illustrated and described as being a right angle electrical connector, it is realized that the electrical connector 104 may have other configurations in alternative embodiments. For example, the electrical connector 104 may be a vertical connector that mates to the bus bar assembly 106 in a perpendicular direction with respect to the electrical element 102. Furthermore, in an alternative embodiment, the electrical element 102 may be a wire or cable that terminates to the electrical connector 104 instead of a printed circuit board.

The bus bar assembly 106 has a first side 110 and a second side 112 opposite the first side 110. The bus bar assembly 106 includes a plurality of layers between the first and second sides 110, 112. For example, the layers include at least one conductive power (or hot) layer 114, at least one conductive ground layer 116, and at least one insulator layer (not shown). Each power layer 114 is configured to conduct a first electrical current for providing power to one or more of the electrical elements 102. Each ground layer 116 is configured to conduct a second electrical current that provides grounding to the electrical elements 102 connected thereto. The first electrical current through the power layer 114 is generally equal to the second electrical current through the ground layer 116, although the first and second electrical currents may be different. The insulator layer may be disposed between the power and ground layers 114, 116 to provide electrical insulation, allowing the layers 114, 116 to carry different voltages and/or currents. As used herein, a set of one power layer 114, one ground layer 116, and one insulator layer therebetween is referred to as a bus bar 118. The bus bar assembly 106 includes any number of bus bars 118 stacked adjacent to each other. In the illustrated embodiment, the bus bar assembly 106 includes two bus bars 118 (for example, a first bus bar 118A and a second bus bar 118B). Optionally, in an alternative embodiment, the bus bar assembly 106 may include only one bus bar 118. Adjacent bus bars 118 are separated by a gap or space 122. The gap 122 may be filled with air to provide a dielectric material between the bus bars 118 to provide electrical insulation and convective heat dissipation. Alternatively, a layer of a solid dielectric material (not shown), such as plastic, may be placed within the gap 122. The first and second bus bars 118A, 118B may abut the solid dielectric layer to maintain a constant width of the gap 122.

In the illustrated embodiment, the bus bar assembly 106 has an elongated and substantially rectangular-shaped body. For example, the sides 110, 112 may have surfaces that coincide with respective planes that extend along the longitudinal and elevation axes 191, 192 and are parallel to each other. The bus bar assembly 106 includes a front edge 124, a rear edge 126, an upper edge 128, and a lower edge 130. As used herein, relative or spatial terms such as "front," "rear," "left," "right," "top," "bottom," and the like, are only used to distinguish the referenced elements and do not necessarily require particular positions or orientations in the electrical system 100 or in the surrounding environment of the electrical system 100. The bus bar assembly 106 includes a plurality of tabs 132 (shown more clearly in FIG. 2) that extend from the front edge 124 and the rear edge 126. The tabs 132 are spaced-apart along the respective front and rear edges 124, 126. In other embodiments, tabs 132 may be disposed along the upper and/or lower edges 128, 130 of the bus bar assembly 106 instead of, or in addition to, being disposed along the front and rear edges 124, 126. In an alternative embodiment, the tabs 132 may extend from the front edge 124 or the rear edge 126, but not both.

The tabs 132 are formed of extensions of some of the layers of the bus bar assembly 106. For example, each tab 132 may include a power finger 134 that extends from the power layer 114, and a ground finger 136 that extends from the ground layer 116. Optionally, one or more of the tabs 132 may include more than one power finger 134 and more than one ground finger 136. The power and ground fingers 134, 136 may be formed integral to the respective power and ground layers 114, 116 from which the fingers 134, 136 extend, such that the tabs 132 are defined along the front and rear edges 124, 126.

The connector shrouds 108 are coupled to the front and rear edges 124, 126 of the bus bar assembly 106. The connector shrouds 108 are configured to receive the tabs 132, and to provide an interface for mating the electrical connector 104 to the bus bar assembly 106 via the tabs 132. Each connector shroud 108 has a base 138 and a mating end 140. A cavity 142 is defined within the connector shroud 108 between the base 138 and mating end 140. At least one tab 132 is received in the cavity 142 through an opening 144 at the base 138. The tabs 132 along the rear edge 126 of the bus bar assembly 106 are received in cavities 142 of connector shrouds 108 coupled to the rear edge 126, and the tabs 132 along the front edge 124 are received in cavities 142 of connector shrouds 108 coupled to the front edge 124. The connector shrouds 108 are configured to be secured to the corresponding tabs 132 such that the connector shrouds 108 are fixed to the bus bar assembly 106 and are not configured to be removable therefrom during ordinary use.

The mating end 140 of the connector shroud 108 defines at least one mating interface 146 that is configured to interconnect with one of the electrical connectors 104. In the illustrated embodiment shown in FIG. 1, each connector shroud 108 includes two mating interfaces 146, with each mating interface 146 configured to mate with a different electrical connector 104. For example, the connector shroud 108A in FIG. 1 is shown mated to two electrical connectors 104 (for example, 104A and 104B). In other embodiments, each connector shroud 108 may include only one mating interface 146 or at least three mating interfaces 146. The mating interface 146 may define a socket that opens to the cavity 142. As the electrical connector 104 is mated to the mating interface 146 of the connector shroud 108, power contacts 148 and ground contacts 150 of the electrical connector 104 are received through the socket into the cavity 142. The power and ground contacts 148, 150 are configured to engage the respective power and ground fingers 134, 136 of the tab 132 within the cavity 142 to form an electrical connection.

In an exemplary embodiment, the connector shroud 108 is not an electrical connector in itself, since it does not include any integral conductors that are mounted to the conductive layers 114, 116 of the bus bar assembly 106. Rather, the connector shroud 108 is used so the electrical system 100 mimics a two-piece connector system without at least some of the inherent issues in known two-piece connector systems. For example, the connector shroud 108 provides the benefits of protecting the thin and relatively fragile layers of the bus bar assembly 106 when mating and unmating the electrical connectors 104 by absorbing some of the forces exerted by the electrical connectors 104. In addition, the connector shroud 108 houses the active power and ground fingers 134, 136, so when the corresponding electrical connector 104 is not mated, the active fingers 134, 136 are not exposed. As a result, the bus bar assembly 106 may be touch safe and the risk of accidental electrical shock significantly diminished. Since the connector shroud 108 does not include integral conductors, the complex mounting process that includes attempting to terminate various contacts of a mounting connector to different layers of the bus bar assembly 106 is eradicated.

Figure 2:
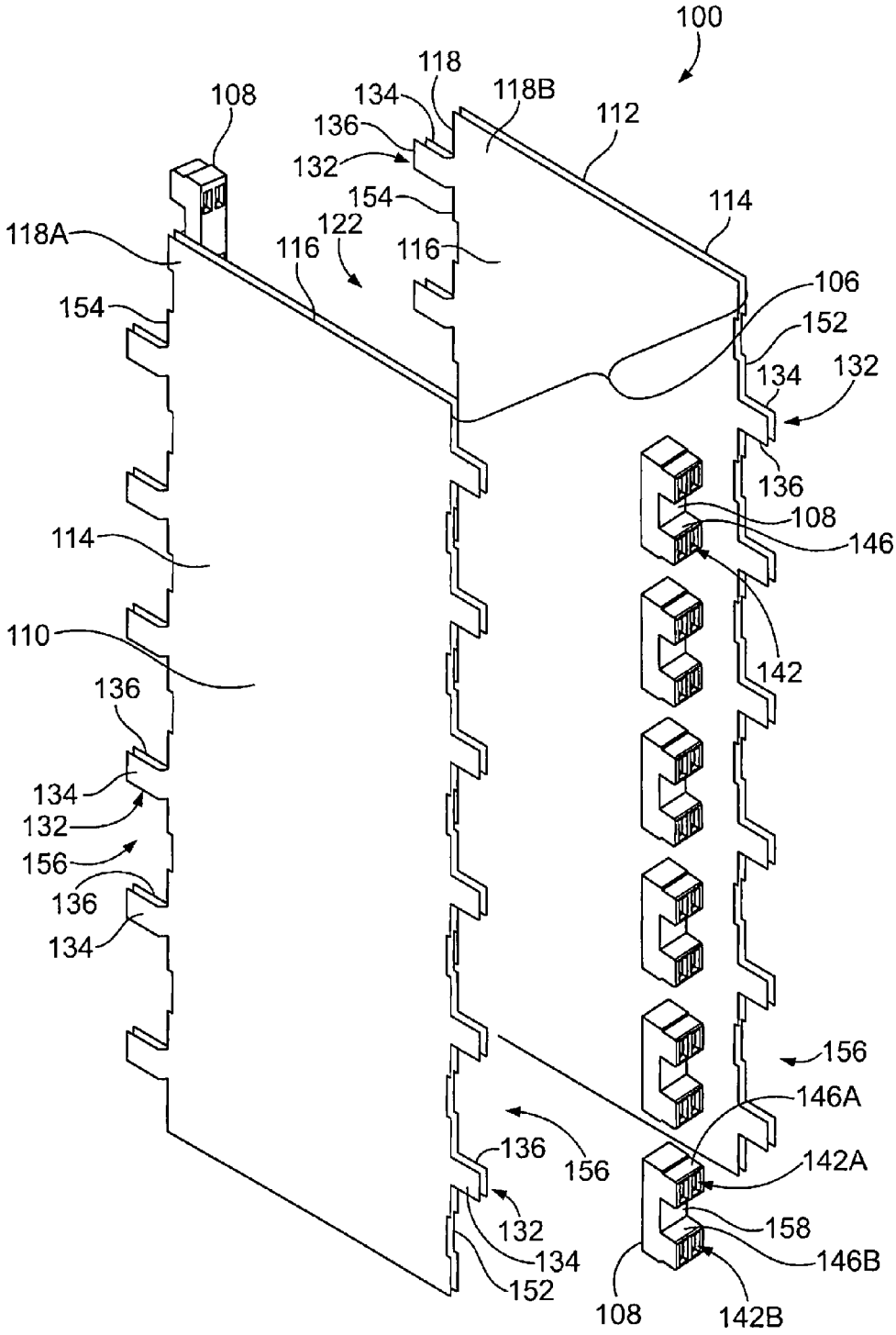
FIG. 2 is an exploded perspective view of a bus bar assembly and connector shrouds of the electrical system according to an exemplary embodiment.

FIG. 2 is an exploded perspective view of the bus bar assembly 106 and the connector shrouds 108 of the electrical system 100 according to an exemplary embodiment. The bus bar assembly 106 in the illustrated embodiment includes the first bus bar 118A and the second bus bar 118B, commonly referred to as bus bars 118. In an embodiment, the conductive power layer 114 of the first bus bar 118A defines the first side 110 of the bus bar assembly 106, and the conductive power layer 114 of the second bus bar 118B defines the second side 112. The conductive ground layers 116 of the first and second bus bars 118A, 118B are disposed between the conductive power layers 114. For example, the ground layers 116 face inward towards the gap 122, and the power layers 114 face outward. The conductive layers 114, 116 of the bus bars 118 are formed of sheets of metal, such as copper, silver, brass, aluminum, or the like. The sheets may be relatively thin compared to the elongated surfaces that form the first and second sides 110, 112 in order to improve heat dissipation from the bus bar assembly 106. The sheets may be stamped or cut to define the respective power and ground fingers 134, 136 of the tabs 132 that extend from front edges 152 and rear edges 154 of the bus bars 118. As shown in FIG. 2, the bus bars 118 each define a plurality of tabs 132 extending from the front and rear edges 152, 154. For example, the power fingers 134 and the ground fingers 136 each have a rectangular shape that is formed by cutting or stamping out regions 156 of the corresponding layers 114, 116 between adjacent fingers 134, 136. In other embodiments, the power fingers 134 and/or ground fingers 136 may have other shapes or sizes.

The conductive power layer 114 is aligned with the conductive ground layer 116 of each bus bar 118 such that the power fingers 134 extending from the power layer 114 align with the ground fingers 136 extending from the ground layer 116 to form the tabs 132. As stated with reference to FIG. 1, the power and ground layers 114, 116 may be separated from each other by an electrical insulator layer (not shown), such that the power and ground layers 114, 116 are electrically independent and capable of having different voltages and/or currents. The electrical insulator layer may be composed of a thin dielectric material, which provides an electrical benefit to the bus bar 118 by increasing capacitance and decreasing inductance across the power and ground layers 114, 116.

In an exemplary embodiment, the tabs 132 of the first bus bar 118A and the tabs 132 of the second bus bar 118B are arranged in a pattern along the length of the front edge 124 (shown in FIG. 1) of the bus bar assembly 106. The front edge 124 is defined by the front edges 152 of the bus bars 118. For example, the tabs 132 may be arranged in an alternating pattern such that the tabs 132 of the second bus bar 118B are interleaved between the tabs 132 of the first bus bar 118A. The tabs 132 of the second bus bar 118B may be viewable through the regions 156 of the first bus bar 118A between the tabs 132 of the first bus bar 118A when viewing the bus bar assembly 106 from a perspective along the lateral axis 193 (shown in FIG. 1). In other embodiments, the tabs 132 of the two bus bars 118A, 118B may be aligned along the lateral axis 193 (shown in FIG. 1) such that a tab 132 of the first bus bar 118A is aligned in a row with a corresponding tab 132 of the second bus bar 118B. The tabs 132 of the bus bar assembly 106 may be arranged in other patterns in other embodiments, and may depend on requirements of a specific application of the electrical system 100. The tabs 132 may also be arranged in a pattern along the rear edge 126 of the bus bar assembly 106, which is defined by the rear edges 154 of the bus bars 118. Optionally, the pattern of tabs 132 along the rear edge 126 may be the same as the pattern of tabs 132 along the front edge 124. Although the tabs 132 are shown in FIG. 2 extending from the front and rear edges 152, 154 of the bus bars 118 at spaced apart locations along the entire length of the bus bars 118, in other embodiments the tabs 132 may be disposed along only portions of the entire length of the front and/or rear edges 152, 154.

The connector shrouds 108 are formed of one or more dielectric materials, such as plastic or another polymer, rubber, or other insulative material. In an embodiment, the connector shrouds 108 are plastic formed by a molding process. Each of the connector shrouds 108 configured to be coupled to the bus bar assembly 106 may be formed using the same process, and may have the same size and shape. Although the connector shroud 108 in other embodiments may include any number of mating interfaces 146 and cavities 142, the connector shrouds 108 shown in FIGS. 1 and 2 have two mating interfaces 146 (for example, an upper interface 146A and a lower interface 146B) and two cavities 142 (for example, an upper cavity 142A and a lower cavity 142B) defined therein. The cavity 142A is within the mating interface 146A, and the cavity 142B is within the mating interface 146B. The two mating interfaces 146A, 146B are held in a spaced apart relationship by a bridge element 158 that connects the mating interfaces 146A, 146B. The bridge element 158 provides space between the mating interfaces 146A, 146B to allow room for separate mating and unmating of different electrical connectors 104 (shown in FIG. 1) to the mating interfaces 146A, 146B. In alternative embodiments in which connector shrouds 108 have only one mating interface 146, the connector shrouds 108 do not include a bridge element 158. In an exemplary embodiment, one of the tabs 132 of the first bus bar 118A is received in the upper or lower cavity 142A or 142B, and one of the tabs 132 of the second bus bar 118B is received in the other cavity 142A or 142B. As a result, the electrical connector 104 that mates with the upper mating interface 146A electrically connects with one of the first or second bus bars 118A, 118B, and the different electrical connector 104 that mates with the lower mating interface 146B electrically connects with the other of the first or second bus bars 118A, 118B. In another embodiment, each cavity 142A, 142B may be configured to receive a tab 132 from both the first bus bar 118A and the second bus bar 118B therein.

Figure 3:
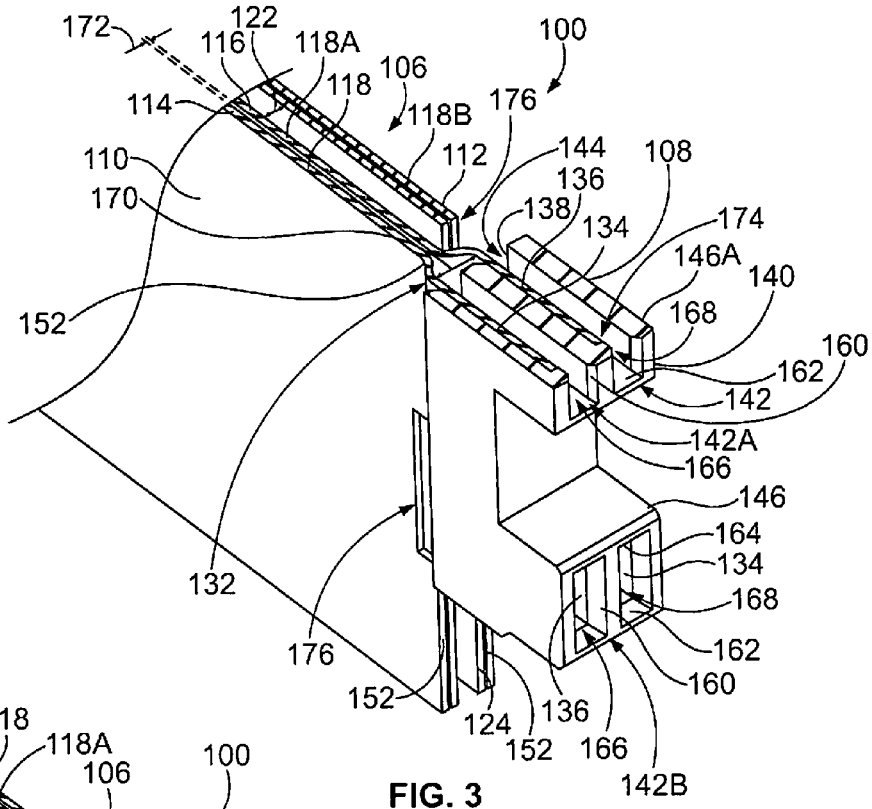
FIG. 3 is perspective view of a portion of the electrical system showing a cross-section of the bus bar assembly and one of the connector shrouds according to an exemplary embodiment.
Figure 4:
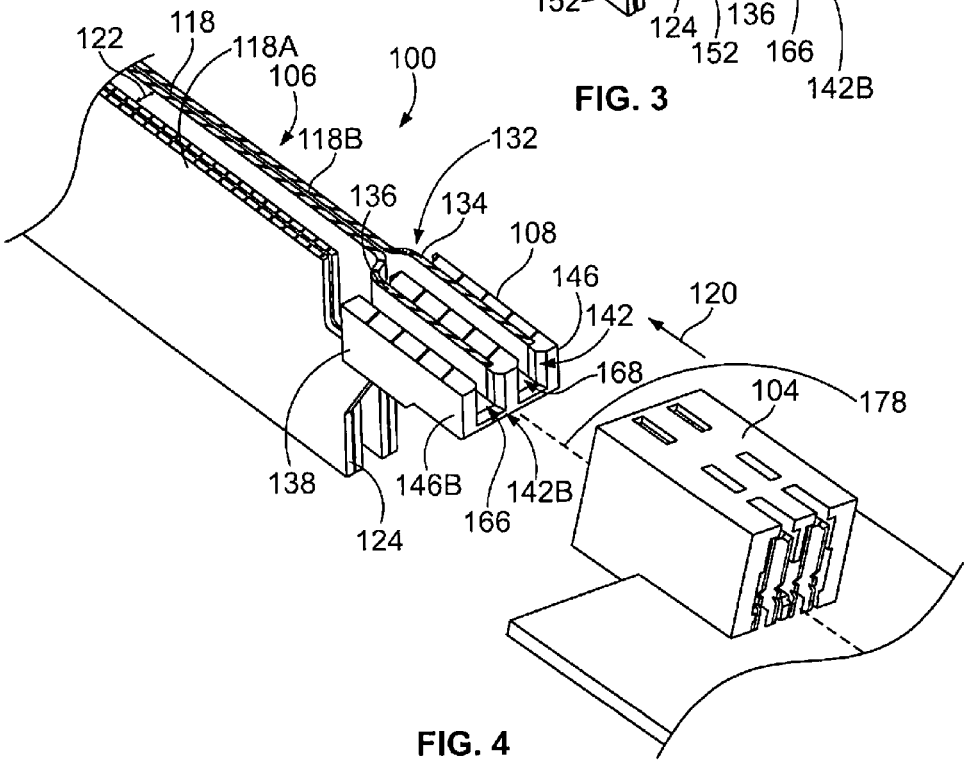
FIG. 4 is a perspective view of a portion of the electrical system showing a cross-section of the bus bar assembly and one of the connector shrouds according to an exemplary embodiment, with an electrical connector poised for mating to the connector shroud.

FIG. 3 is perspective view of a portion of the electrical system 100 showing a cross-section of the bus bar assembly 106 and one of the connector shrouds 108 according to an exemplary embodiment. FIG. 4 is a perspective view of another portion of the electrical system 100 showing a different cross-section of the bus bar assembly 106 and one of the connector shrouds 108 according to an exemplary embodiment. FIG. 4 also shows one of the electrical connectors 104 poised for mating to the connector shroud 108. In FIG. 3, the cross-section is taken through the upper mating interface 146A of the connector shroud 108. In FIG. 4, the cross-section is taken through the lower mating interface 146B of the same or a different connector shroud 108.

In an embodiment, the connector shroud 108 includes a middle wall 160 that extends within each cavity 142 from the base 138 to the mating end 140. The middle wall 160 may extend from a bottom interior wall 162 of the mating interface 146 to a top interior wall 164 of the mating interface 146. The middle wall 160 splits or divides the corresponding cavity 142 into a first channel 166 and a second channel 168. The first channel 166 may be proximate to the first side 110 of the bus bar assembly 106, and the second channel 168 may be proximate to the second side 112. In an exemplary embodiment, the connector shroud 108 includes two mating interfaces 146A, 146B and two respective cavities 142A, 142B extending therethrough. The tab 132 extending from the first bus bar 118A may be received in the upper cavity 142A such that the power finger 134 of the tab 132 is received in the first channel 166 and the ground finger 136 is received in the second channel 168. Inversely, as shown in FIG. 4, the tab 132 extending from the second bus bar 118B is received in the lower cavity 142B such that the power finger 134 of the tab 132 is received in the second channel 168 and the ground finger 136 is received in the first channel 166. The power and ground fingers 134, 136 of the tabs 132 of the first and second bus bars 118A, 118B may have different relative positions in the cavity or cavities 142 of the connector shroud 108 in alternative embodiments.

With continued reference to FIGS. 3 and 4, the placement of the power and ground fingers 134, 136 of the first bus bar 118A in the first and second channels 166, 168 of the upper cavity 142A may be opposite the placement of the power and ground fingers 134, 136 of the second bus bar 118B in the channels 166, 168 of the lower cavity 142B. As a result, the upper mating interface 146A may be configured to engage an electrical connector 104 that is oriented 180° from an orientation of an electrical connector 104 configured to engage the lower mating interface 146B. For example, referring back to FIG. 1, the electrical connectors 104A and 104B that are mated to the connector shroud 108A are oriented 180° from each other. The electrical element 102 attached to the electrical connector 104A is disposed above the electrical connector 104A, and the electrical element 102 corresponding to the electrical connector 104B is disposed below the electrical connector 104B.

Referring back to FIG. 3, the sizes of the channels 166, 168 of the cavity 142, as well as the width of the middle wall 160 between the channel 166, 168, are designed and configured to accommodate the power contacts 148 (shown in FIG. 1) and ground contacts 150 (FIG. 1) of the electrical connector 104 (FIG. 1). The power finger 134 of each tab 132 is located in a different one of the channels 166, 168 than the ground finger 136. A distance 170 between the power and ground fingers 134, 136 of the tab 132 within the cavity 142 may be different than a distance 172 between the conductive power and ground layers 114, 116 of the bus bar 118 from which the tab 132 extends. For example, the distance 170 between the power and ground fingers 134, 136 may be greater than the distance 172 between the power and ground layers 114, 116, which is a relatively small distance, in order for the power and ground fingers 134, 136 to be properly received within the channels 166, 168. As stated above, the channels 166, 168 may be sized based on the characteristics of the mating electrical connector 104. In an embodiment, the power finger 134 and/or the ground finger 136 of each tab 132 of the bus bar assembly 106 may be stepped at the front edge 152 of the corresponding bus bar 118 to provide the wider distance 170 between the power and ground fingers 134, 136. The power and ground fingers 134, 136 may be separated by the distance 170 along substantially the entire length of the tab 132, as shown in FIG. 3, or at least at a distal end 174 of the tab 132. In the illustrated embodiment, both the power and ground fingers 134, 136 are stepped outward away from each other. The fingers 134, 136 may be stepped by bending or forming the fingers 134, 136 in an s-curve. The fingers 134, 136 may be easily bent due to the thin, pliable metal from which the conductive layers 114, 116 are formed. In other embodiments, at least one of the fingers 134, 136 may not be stepped at all or may be stepped at least partially inward towards the other finger 134 or 136.

Optionally, the front edges 152 of the bus bars 118 may be recessed at various positions along the lengths to provide windows 176. The windows 176 may be positioned to laterally align with tabs 132 on the adjacent bus bar 118. The windows 176 provide space for the power and/or ground fingers 134, 136 of the adjacent tabs 132 to be stepped at least partially into the plane of the bus bar 118 without interfering with the spacing between the two adjacent bus bars 118. For example, the windows 176 along the second bus bar 118B may allow the ground fingers 136 of the tabs 132 of the first bus bar 118A to be stepped or bent widely at the front edge 124 to be received within the cavity 142 of the connector shroud 108 without widening the gap 122 between the bus bars 118A, 118B. In addition, stepping the power and/or ground fingers 134, 136 at the front edge 124, instead of some location past the front edge 124, allows the base 138 of each connector shroud 108 to extend fully to the front edge 124 when coupling to the bus bar assembly 106.

Each connector shroud 108 is configured to be secured to a corresponding tab 132. For example, connector shroud 108 may secure and retain the tab 132 in the cavity 142 by an interference fit, an adhesive, a retention latch or other mechanism, and/or the like. The tab 132 may be secured to the connector shroud 108 such that removal of the connector shroud 108 from the bus bar assembly 106 is difficult and undesirable. In an example of an interference fit, the power and ground fingers 134, 136 may be deflectable, and loading the fingers 134, 136 through an opening 144 in the base 138 causes interior walls of the connector shroud 108 to deflect the fingers 134, 136, which biases the fingers 134, 136 to impart a resistive normal force on the interior walls. Some examples of adhesives that may be used to secure the power and ground fingers 134, 136 of the tab 132 to the connector shroud 108 are various epoxies, glues, and the like. In addition, the power finger 134 and/or ground finger 136 of the tab 132 may include a latching feature that interacts with a complementary latching feature along an interior wall of the connector shroud 108 once the tab 132 is fully loaded into the cavity 142 to form a retention latching mechanism. The latching mechanism prohibits the connector shroud 108 from being pulled away from the tab 132 of the bus bar assembly 106, and vice-versa. The connector shrouds 108 of the electrical system 100 may be secured to the tabs 132 of the bus bar assembly 106 using one or more other mechanisms in other embodiments.

In an embodiment, the connector shroud 108 may be used to position and hold the bus bars 118 of the bus bar assembly 106 relative to each other. For example, as shown in FIG. 3, the tab 132 extending from the first bus bar 118A is secured in the first cavity 142A, and, as shown in FIG. 4, the tab 132 extending from the second bus bar 118B is secured in the second cavity 142B. Since the tabs 132 of each of the bus bars 118A, 118B are held in place by common connector shrouds 108, the connector shrouds 108 may retain the width of the gap 122 between the bus bars 118A, 118B. For example, connector shrouds 108 at the front edge 124 may retain the gap 122 at the front, and connector shrouds 108 at the rear edge 126 (shown in FIG. 1) may retain the gap 122 at the rear, such that the width of the gap 122 is consistent along the entire surface areas of the bus bars 118. As a result, since the spacing and framing between the bus bars 118 are provided by the connector shrouds 108 at the edges 124, 126 of the bus bar assembly 106, the gap 122 may be filled with air, which provides convective heat dissipation away from the bus bar assembly 106. Alternatively, or in addition, a layer of another dielectric material, such as a plastic, may be placed in the gap 122 for electrical insulation and structural support.

Referring now to FIG. 4, the bus bars 118 may be generally planar, except for the power fingers 134 and/or ground fingers 136 of the tabs 132, which may be stepped as described above. The planar bus bars 118 are stacked adjacent to each other to form the bus bar assembly 106, so the bus bar assembly 106 is also generally planar. In an exemplary embodiment, the connector shrouds 108 are coupled to the front edge 124 of the bus bar assembly 106 such that the cavity or cavities 142 extend co-planar to the plane of the bus bar assembly 106. The electrical connector 104 is configured to mate to the mating interface 146 of the connector shroud 108 in the mating direction 120 which is along a mating axis 178. The mating axis 178 may also be co-planar to the plane of the bus bar assembly 106.

As described above, there is a known issue of incompatibility between bus bar assemblies 106 of varying thicknesses and electrical connectors 104 of varying sizes and shapes. Typically, the solution is to substitute the electrical connector 104 mounted to the electrical element 102 (shown in FIG. 1) to be compatible with the bus bar assembly 106, or vice-versa. However, since the connector shroud 108 functions as an adapter between the electrical connector 104 and the bus bar assembly 106, and the connector shroud 108 may be formed by molding or another relatively simple manufacturing process, it generally would be cheaper and easier to modify the connector shroud 108 instead of switching the bus bar assembly 106 or the electrical connector 104. For example, the mating interface 146 and the cavity 142 of the connector shroud 108 may be formed to mate with specific electrical connectors 104. The base 138 of the connector shroud 108 may be formed to mate with specific thicknesses of bus bar assemblies 106. In addition, the tabs 132 of the bus bar assembly 106 may be stepped or otherwise formed to be received within different sizes of cavities 142 of the connector shroud 108. As a result, it may be cheaper and more efficient to manufacture various types and sizes of connector shrouds 108, which may be selected based on the specific characteristics of the bus bar assembly 106 and the electrical connector 104, as opposed to being forced to switch the bus bar assembly 106 or the electrical connector 104 if the components are incompatible.

Figure 5:
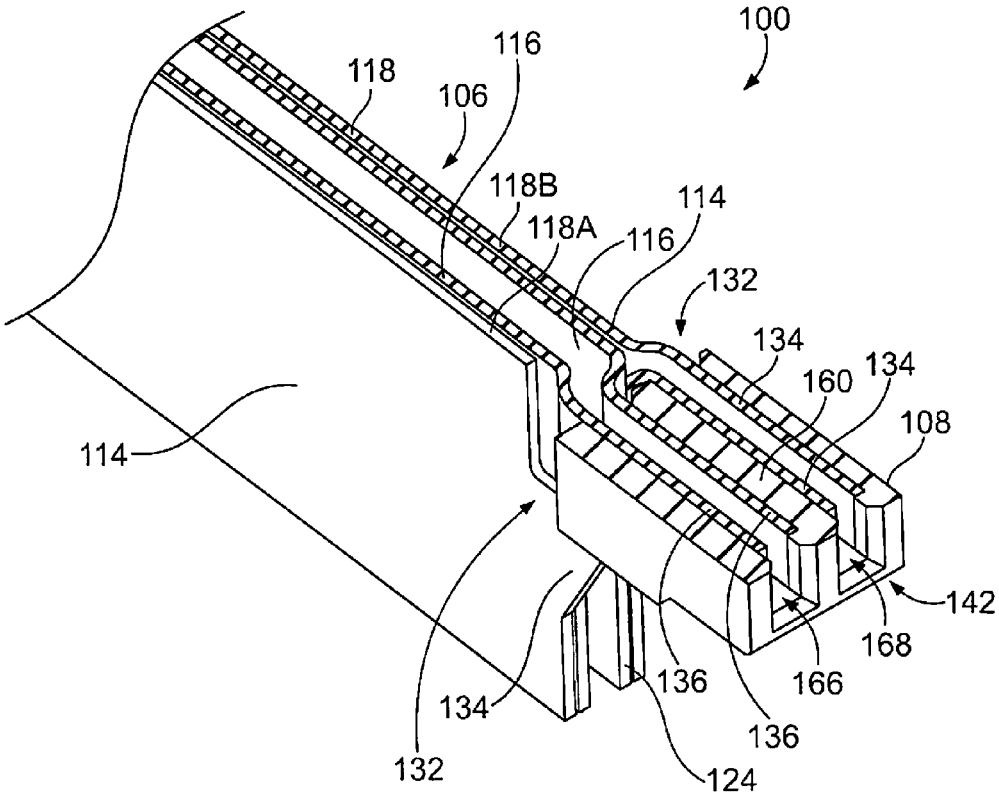
FIG. 5 is a perspective view of a portion of the electrical system showing a cross-section of the bus bar assembly and one of the connector shrouds according to an alternative embodiment.

FIG. 5 is a perspective view of a portion of the electrical system 100 showing a cross-section of the bus bar assembly 106 and one of the connector shrouds 108 according to an alternative embodiment. FIG. 5 shows an embodiment in which a single cavity 142 of the connector shroud 108 receives one tab 132 from the first bus bar 118A and one tab 132 from the second bus bar 118B. The middle wall 160 divides the cavity 142 into the first and second channels 166, 168. The power fingers 134 of both tabs 132 are received in the second channel 168, and the ground fingers 136 of both tabs 132 are received in the first channel 166. As a result, both power fingers 134 are configured to electrically engage the power contacts 148 (shown in FIG. 1) of the electrical connector 104 (FIG. 1), and both ground fingers 136 are configured to electrically engage the ground contacts 150 (FIG. 1) of the connector 104. This arrangement may be used to provide additional power to the electrical element 102 (shown in FIG. 1) coupled to the electrical connector 104, since the power contacts 148 of the connector 104 receive a voltage from each of the bus bars 118A, 118B.

In this embodiment, at least one of the power fingers 134 or ground fingers 136 of the tabs 132 may need to extend across one or more of the other power or ground fingers 134, 136 in order to be received within the designated channel 166, 168. One technique is to fashion one of the fingers 134, 136 to extend over or under one or more other fingers 134, 136. For example, as shown in FIG. 5, the power finger 134 of the tab 132 of the first bus bar 118A may extend under both of the ground fingers 136 of the first and second bus bars 118A, 118B. The ground fingers 136 are received in the first channel 166, which is proximate to conductive power layer 114 of the first bus bar 118A from which the power finger 134 extends. The power finger 134 of bus bar 118A extends from the front edge 124 of the bus bar assembly 106 at a location below the other power finger 134 of bus bar 118B and the ground fingers 136. The power finger 134 extends at least partially upward and towards the second bus bar 118B in order to pass underneath the ground fingers 136 and be received within the second channel 168 of the cavity 142. Alternatively, the power finger 134 may extend over the ground fingers 136 instead of under. In an alternative embodiment, the ground fingers 136 may be formed or cut to form slots (not shown) at the front edge 124 of the bus bar assembly 106. The power finger 134 may be bent to extend across the ground fingers 136 to the second channel 168 by extending through the slots of the ground fingers 136. The slots may be sized such that the power finger 134 does not mechanically engage the ground fingers 136, so the conductive power and ground layers 114, 116 are maintained to be electrically independent.

Figure 6:
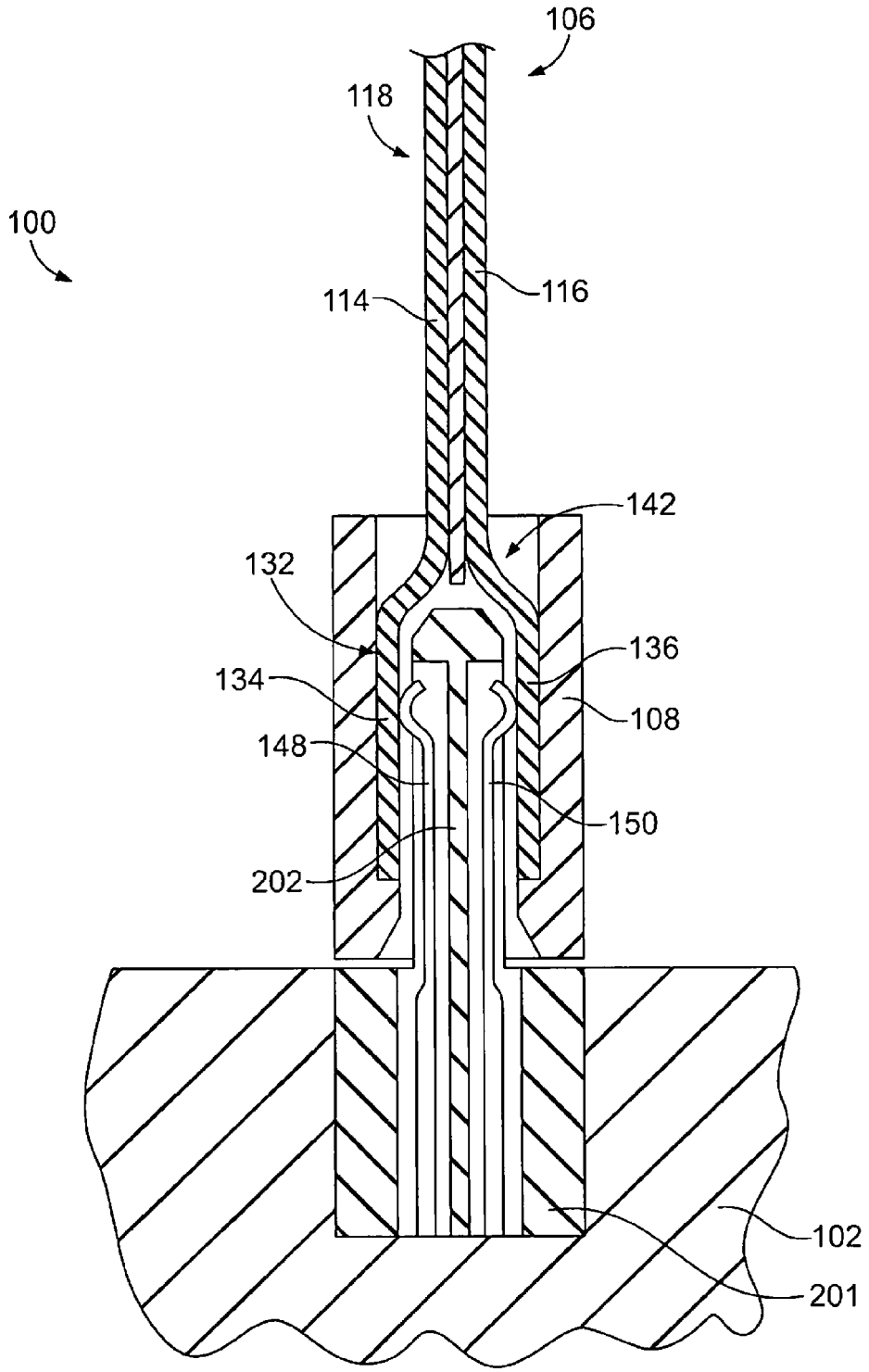
FIG. 6 is a top-down view of a cross-section of the electrical system according to another alternative embodiment.

FIG. 6 is a top-down view of a cross-section of the electrical system 100 according to another alternative embodiment. The bus bar assembly 106 shown in FIG. 6 only includes one bus bar 118, though additional bus bars 118 may be included in other embodiments. The tab 132 of the bus bar 118 is within the cavity 142 of the connector shroud 108. The shroud 108 does not include an integral middle wall 160 (shown in FIG. 3), so the power finger 134 that extends from the conductive power layer 114 is not separated from the ground finger 136 that extends from the conductive ground layer 116 by a middle wall 160. The electrical system 100 shown in FIG. 6 is configured to electrically connect to an electrical connector 201 that is mounted to the electrical element 102. The electrical connector 201 differs from the electrical connector 104 (shown in FIGS. 1 and 4). For example, the electrical connector 201 includes a mating arm 202 that extends into the cavity 142 of the connector shroud 108 when the electrical connector 201 is coupled to the connector system 100. The mating arm 202 provides electrical shielding and insulation between the power contact 148 and the ground contact 150 of the electrical connector 201. As the mating arm 202 is received in the cavity 142, the power contact 148 electrically and mechanically engages the power finger 134, and the ground contact 150 electrically and mechanically engages the ground finger 136. Thus, although both the power and ground fingers 134, 136 are received in the same cavity 142 without a middle wall 160 disposed therebetween, the mating arm 202 of the electrical connector 201 provides shielding and electrical insulation between the power connection and the ground connection to reduce crosstalk and other interference.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical system comprising:

a bus bar having a first side and a second side, the bus bar including a plurality of layers between the first and second sides including a conductive power layer and a conductive ground layer, the bus bar having a front edge defining a plurality of tabs extending therefrom at spaced-apart locations along the front edge, each tab including a power finger extending from the power layer and a ground finger extending from the ground layer; and a connector shroud coupled to the front edge of the bus bar, the connector shroud having a base and a mating end and defining a cavity therebetween, the cavity receiving at least one of the tabs through an opening at the base, the mating end defining a mating interface configured to mate with an electrical connector, wherein the cavity is configured to receive power and ground contacts of the electrical connector therein for electrical connection to the respective power and ground fingers of the at least one tab.

2. The electrical system of claim 1, wherein at least one of the power finger or the ground finger of each tab is stepped at the front edge of the bus bar such that a distance between the power finger and the ground finger at a distal end of each tab is different than a distance between the corresponding power and ground layers from which the fingers extend.

3. The electrical system of claim 1, wherein the connector shroud includes a middle wall within the cavity that extends from the base to the mating end, the middle wall dividing the cavity into first and second channels, wherein the power finger of the at least one tab is received in the first channel and the ground finger of the at least one tab is received in the second channel.

4. The electrical system of claim 1, wherein the connector shroud is composed of a dielectric material.

5. The electrical system of claim 1, wherein the bus bar is planar, the connector shroud coupled to the front edge of the bus bar such that the cavity of the connector shroud extends co-planar to the plane of the bus bar, the electrical connector configured to mate to the mating interface of the connector shroud along a mating axis that is co-planar to the plane of the bus bar.

6. The electrical system of claim 1, wherein the at least one tab is retained in the connector shroud by at least one of an interference fit, an adhesive, or a retention latch between the power and ground fingers of the at least one tab and corresponding interior walls of the connector shroud that engage the power and ground fingers.

7. The electrical system of claim 1, wherein the power layer and the ground layer are formed of copper, the power and ground layers separated by an electrical insulator layer such that the power and ground layers are electrically independent and capable of having different voltages.

8. An electrical system comprising:

a bus bar assembly including first and second bus bars, each bus bar including a conductive power layer and a conductive ground layer, each bus bar having a front edge defining a plurality of tabs extending therefrom, each tab including a power finger extending from the power layer and a ground finger extending from the ground layer, the bus bar assembly having a first side and a second side, the conductive power layer of the first bus bar defining the first side and the conductive power layer of the second bus bar defining the second side such that the conductive ground layers of the first and second bus bars are disposed between the conductive power layers; and a connector shroud coupled to a front edge of the bus bar assembly defined by the front edges of the first and second bus bars, the connector shroud having a base and a mating end and defining a cavity therebetween, the cavity receiving at least one of the tabs of the bus bar assembly through an opening at the base, the mating end defining a mating interface configured to mate with an electrical connector, wherein the cavity is configured to receive power and ground contacts of the electrical connector therein for electrical connection to the respective power and ground fingers of the at least one tab within the cavity.

9. The electrical system of claim 8, wherein the tabs of the first bus bar and the tabs of the second bus bar are arranged in an alternating pattern along a length of the front edge of the bus bar assembly.

10. The electrical system of claim 8, wherein the cavity and the mating interface of the connector shroud are a first cavity and a first mating interface, respectively, the connector shroud further including a second cavity and a second mating interface spaced apart from the respective first cavity and first mating interface, wherein the at least one tab of the bus bar assembly received in the first cavity is one of the plurality of tabs extending from the first bus bar, and one of the plurality of tabs extending from the second bus bar is received in the second cavity of the connector shroud, the first and second mating interfaces configured to mate to different electrical connectors.

11. The electrical system of claim 10, wherein the connector shroud includes a middle wall within each of the first and second cavities that extends at least partially from the base to the mating end, the middle walls dividing each of the first and second cavities into first and second channels, the first channels proximate to the first side of the bus bar assembly, the second channels proximate to the second side of the bus bar assembly, wherein the tab extending from the first bus bar is received in the first cavity such that the power finger is received in the first channel and the ground finger is received in the second channel, and wherein the tab extending from the second bus bar is received in the second cavity such that the power finger is received in the second channel and the ground finger is received in the first channel.

12. The electrical system of claim 10, wherein the first bus bar is separated from the second bus bar by a gap, the tab extending from the first bus bar is secured in the first cavity of the connector shroud and the tab extending from the second bus bar is secured in the second cavity of the connector shroud to retain the width of the gap.

13. The electrical system of claim 8, wherein the cavity of the connector shroud is configured to receive one tab from the first bus bar and one tab from the second bus bar therein.

14. The electrical system of claim 13, wherein the connector shroud includes a middle wall within the cavity that extends from the base to the mating end, the middle wall dividing the cavity into first and second channels, wherein the power fingers of both tabs are received in the first channel and the ground fingers of both tabs are received in the second channel.

15. The electrical system of claim 8, wherein at least one of the power finger or the ground finger of each tab of the bus bar assembly is stepped at the front edge of the corresponding first or second bus bar such that a distance between the power finger and the ground finger at a distal end of each tab is different than a distance between the corresponding power and ground layers of the bus bar from which each tab extends.

16. The electrical system of claim 8, wherein the bus bar assembly is planar, the connector shroud coupled to the front edge of the bus bar assembly such that the cavity of the connector shroud extends co-planar to the plane of the bus bar assembly, the electrical connector configured to mate to the mating interface of the connector shroud along a mating axis that is co-planar to the plane of the bus bar assembly.

17. The electrical system of claim 8, wherein the at least one tab is retained in the cavity of the connector shroud by at least one of an interference fit, an adhesive, or a retention latch between the power and ground fingers of the at least one tab and corresponding interior walls of the connector shroud that engage the power and ground fingers.

18. The electrical system of claim 8, wherein the power layer and the ground layer of each of the first and second bus bars are formed of copper, the power and ground layers separated by an electrical insulator layer such that the power and ground layers are electrically independent and capable of having different voltages.

19. The electrical system of claim 8, wherein the connector shroud is composed of a dielectric material.

20. The electrical system of claim 8, wherein the connector shroud is a first connector shroud, the bus bar assembly including a rear edge opposite to the front edge, the rear edge including plural tabs extending therefrom, the electrical system further comprising a second connector shroud coupled to the rear edge of the bus bar assembly, at least one of the tabs extending from the rear edge received in a cavity of the second connector shroud for electrical connection to another electrical connector.

* * * * *